US011352118B1

(12) United States Patent
Dengel et al.

(10) Patent No.: US 11,352,118 B1
(45) Date of Patent: Jun. 7, 2022

(54) MARINE PROPULSION CONTROL METHOD AND SYSTEM

(71) Applicant: Brunswick Corporation, Mettawa, IL (US)

(72) Inventors: Michael P. Dengel, Malone, WI (US); Mark R. Hanson, Oshkosh, WI (US); Peter C. Schneider, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 345 days.

(21) Appl. No.: 16/681,419

(22) Filed: Nov. 12, 2019

(51) Int. Cl.
*G05D 1/00* (2006.01)
*B63H 21/21* (2006.01)

(52) U.S. Cl.
CPC ..... *B63H 21/21* (2013.01); *B63H 2021/216* (2013.01)

(58) Field of Classification Search
CPC ..... B63H 21/21; B63H 20/00
See application file for complete search history.

(56) References Cited

U.S. PATENT DOCUMENTS

| | | | | |
|---|---|---|---|---|
| 4,934,903 | A * | 6/1990 | Sougawa | F01M 1/22 417/63 |
| 6,298,824 | B1 | 10/2001 | Suhre | |
| 6,701,890 | B1 | 3/2004 | Suhre et al. | |
| 9,103,287 | B1 | 8/2015 | Arbuckle et al. | |
| 9,868,501 | B1 * | 1/2018 | Gable | B63H 21/213 |
| 10,155,578 | B1 | 12/2018 | Osthelder et al. | |
| 2002/0065169 | A1 * | 5/2002 | Suzuki | F02B 61/045 477/109 |

* cited by examiner

*Primary Examiner* — John Kwon
(74) *Attorney, Agent, or Firm* — Andrus Intellectual Property Law, LLP

(57) ABSTRACT

A method for controlling propulsion of at least two marine drives on a marine vessel includes monitoring an engine output indicator for each of the at least two marine drives on the marine vessel and detecting whether the engine output indicator for a subset of those at least two marine drives is below an expected value. If so, then an output restriction is imposed on at least one remaining marine drive not in the subset of marine drives, wherein the output restriction reduces an engine output of the at least one remaining marine drive to a predetermined level.

20 Claims, 8 Drawing Sheets

MARINE PROPULSION CONTROL METHOD AND SYSTEM

FIELD

The present disclosure generally relates to methods and systems for controlling propulsion of a marine vessel, and more particularly to methods and systems involving propulsion control by two or more marine drives where a subset of the marine drives experiences a sudden reduction in output, such as due to a sudden lack of fuel supply to a subset of the marine drives or due to a sudden mechanical failure of a subset of the marine drives.

BACKGROUND

U.S. Pat. No. 6,298,824 discloses a control system for a fuel injected engine provides an engine control unit that receives signals from a throttle lever that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle lever and the throttle plate. All operating parameters are either calculated as a function of ambient conditions or determined by selecting parameters from matrices which allow the engine control unit to set the operating parameters as a function of engine speed and torque demand, as represented by the position of the throttle lever U.S. Pat. No. 6,701,890 discloses an engine control system calculates air velocity through a throttle body as a function of mass airflow through the throttle body, air density, and the effective area of airflow through the throttle body as a function of throttle plate position. Mass airflow is calculated as a function of the effective area through the throttle body, barometric pressure, manifold pressure, manifold temperature, the ideal gas constant, and the ratio of specific heats for air. By controlling the throttle plate position as a dual function of throttle demand, which is a manual input, and air velocity through the throttle body, certain disadvantages transient behavior of the engine can be avoided.

U.S. Pat. No. 9,103,287 discloses drive-by-wire control systems and methods for a marine engine that utilize an input device that is manually positionable to provide operator inputs to an engine control unit (ECU) located with the marine engine. The ECU has a main processor that receives the inputs and controls speed of the marine engine based upon the inputs and a watchdog processor that receives the inputs and monitors operations of the main processor based upon the inputs. The operations of the main processor are communicated to the watchdog processor via a communication link. The main processor causes the watchdog processor to sample the inputs from the input device at the same time as the main processor via a sampling link that is separate and distinct from the communication link. The main processor periodically compares samples of the inputs that are simultaneously taken by the main processor and watchdog processor and limits the speed of the engine when the samples differ from each other by more than a predetermined amount.

U.S. Pat. No. 9,868,501 discloses a method for controlling propulsion of two or more marine drives in a marine vessel that includes detecting a fault condition relating to a first marine drive, and determining, at a first control module associated with the first marine drive, a power limit restriction for the first marine drive based on the fault condition. The method further includes communicating the power limit restriction with the first control module on a CAN bus of the marine vessel, and receiving the power limit restriction at a second control module associated with a second marine drive. The power output of the second marine drive is then reduced based on the power limit restriction for the first marine drive.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a method for controlling propulsion of at least two marine drives on a marine vessel includes monitoring an engine output indicator for each of the at least two marine drives on the marine vessel and detecting whether the engine output indicator for a subset of those at least two marine drives is below an expected value. If so, then an output restriction is imposed on at least one remaining marine drive not in the subset of marine drives experiencing the below-expected output, wherein the output restriction reduces an engine output of the at least one remaining marine drive to a predetermined level and maintains the engine output at or below the predetermined level.

One embodiment of a system for controlling propulsion of the marine vessel includes at least two marine drives, such as a first marine drive and a second marine drive, and at least one controller associated with each marine drive, such as at least first controller associated with the first marine drive and at least a second controller associated with the second marine drive. The controllers, such as the first controller and the second controller, are configured to monitor an engine output indicator for each of the at least two marine drives and detect whether the engine output indicator for a subset of the at least two marine drives is below an expected value. If so, then an output restriction is imposed on at least one remaining marine drive not in the subset of marine drives, wherein the output restriction reduces an engine output of the at least one remaining marine drive to a predetermined level and maintains the engine output at or below the predetermined level.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
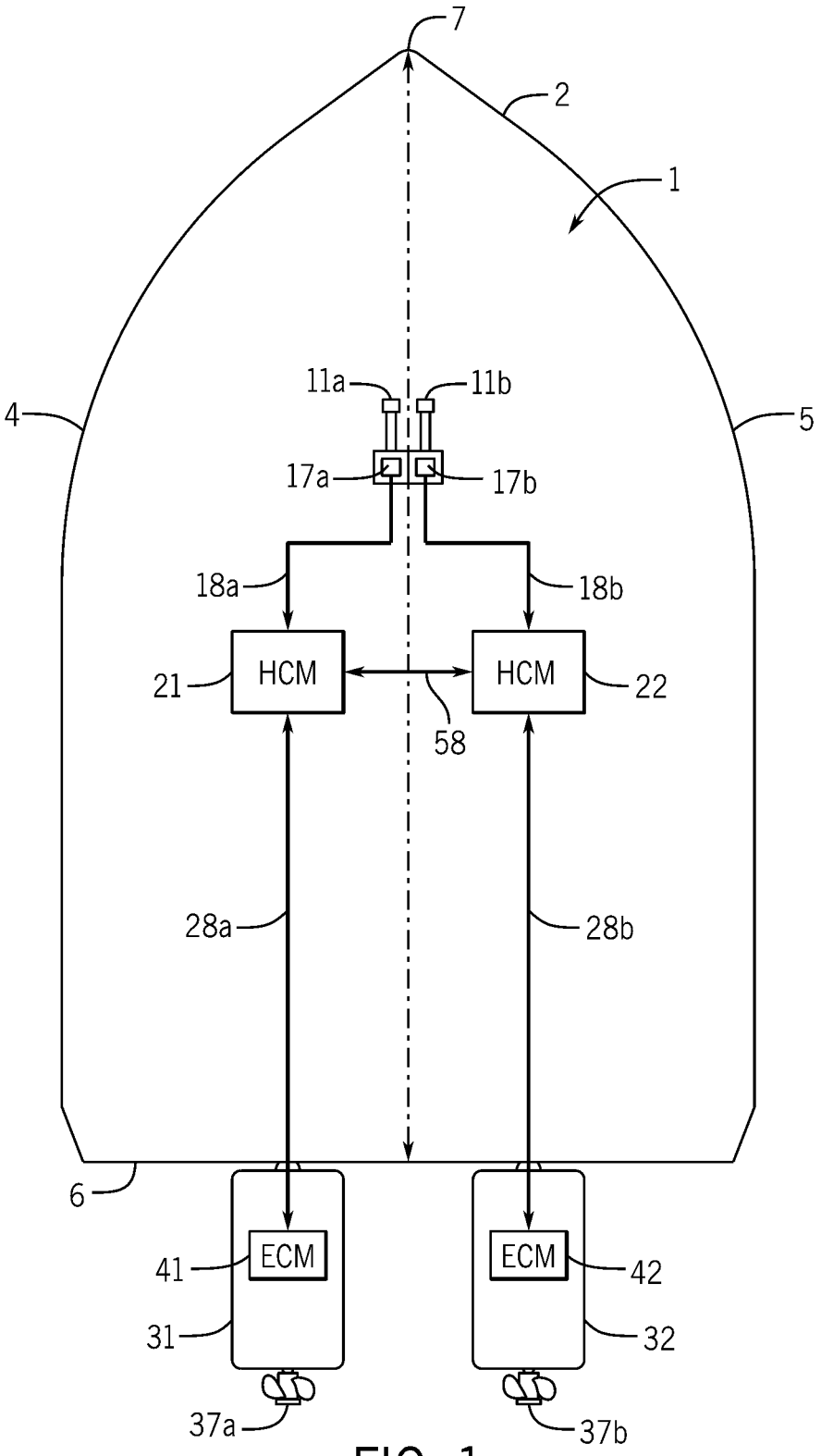
FIG. 1 schematically depicts one embodiment of a system for controlling propulsion of the marine vessel.

The present inventors have recognized that a potentially dangerous situation may occur in certain marine applications involving two or more marine drives, especially in marine racing applications or other high speed operations of marine vessels, where the power output of one marine drive is suddenly reduced due to a mechanical failure or other issue that causes a marine drive to stop operating, such as a problem in the engine of the respective marine drive, or the fuel supply thereto, or even an accidental bump of the keyswitch to cause the drive to suddenly shut off. The sudden reduction in output power by the problematic marine drive causes differing power outputs from each marine drive on a marine vessel despite the operator requesting the same power from all engines. The sudden unbalanced output power can introduce undesired steering torques which, especially at high speed operations, may result in dangerous operating conditions for a drivers and passengers on the marine vessel and/or may cause damage to the marine vessel.

The inventors have recognized that prior art solutions are available where a power limit is placed on a marine drive by a control module when a fault condition is detected somewhere in the marine drive or associated systems. When the power output of one marine drive in a multi-drive system is reduced and limited following fault detection to protect the marine drive from unnecessary damage, certain systems may impose a power output restriction on the other drives in the multi-drive system in order to avoid the unbalanced output power discussed above. However, the present inventors have recognized that not all mechanical or power issues that cause a sudden reduction or stop in engine speed are recognized faults that get detected by a control system, and thus the situation may still occur where one of the marine drives suddenly stops or has a significant power reduction that causes an unbalanced output power.

In light of the foregoing continued problems recognized by the inventors and potential dangers caused by sudden differential power outputs between marine drives on opposite sides of the vessel centerline, the inventors developed the presently disclosed system and method for controlling propulsion of the marine vessel by two or more marine drives wherein, upon detection of an engine output indicator for subset of the at least two marine drives being below an expected value, an output restriction is imposed on one or more of the remaining marine drives that does not have the below-expected output, such as sudden drop in engine speed or output power percent. The output restriction reduces the engine speed of one or all of the remaining marine drives to a predetermined and/or calibratable level and maintains the engine speed at or below that predetermined level until a condition occurs indicating that the propulsion system can be controlled safely. For example, if one or a subset of the marine drives on a vessel suddenly loses engine speed, the sudden loss of engine speed will be detected and the remaining drives will be controlled in order to balance the power output on either side of a vessel centerline to avoid any signification power imbalance and undesired steering torque caused thereby.

In one embodiment, an output restriction, such as an engine speed or demand percent restriction, is imposed equally on all marine drives once the sudden reduction in engine speed of one engine is detected. In another embodiment, the remaining drives not experiencing the engine speed loss may be controlled differently depending on their position on the marine vessel. Once the power output of each of the marine drives is controlled such that a power imbalance with respect to the centerline is mitigated, and thus the threat of an undesired or dangerous situation is avoided, the output restriction may be removed from one or all of the marine drives. In one embodiment, the system may require a user to take affirmative action to remove the output restriction, such as reducing the power demand to at or below a threshold level by pulling back the remote control lever accordingly. At that point, the operator will be aware of the potential power imbalance due to the sudden loss of engine speed of one or a subset of the marine drives and will be able to compensate and operate the propulsion system accordingly.

As will be known to one of ordinary skill in the art, a power limit restriction is a limitation on the maximum power output of a marine drive and is generally implemented as a protection mechanism by an associated controller, such as an engine control module or helm control module. For example, the output restriction may be an engine speed limit and/or an engine speed reduction rate imposed in order to bring the engine speed down to a predetermined level. To provide another example, the output restriction may be a power output percent limit, which is a between 0% and 100%, where 0% represents zero power output and 100% represents the maximum power output that the engine is capable of. Airflow to the engine of the marine drive is often used as a proxy for power output of the marine drive, such as intake airflow measured by the mass airflow sensor; but in other embodiments may be any other engine parameter for normalizing power output, such as torque. Thus, 0 grams per second airflow is determined to be 0% power output, and a predetermined maximum airflow (e.g., 1100 grams/second) is associated as being 100% power output. Such power calculations are known and disclosed in the relevant art, including in U.S. Pat. Nos. 6,298,824 and 6,701,890 incorporated by reference above, and also in U.S. Pat. No. 5,595,159 which are hereby incorporated by reference in their entirety. Accordingly, in one embodiment the output restriction is enacted as an airflow restriction, such as by controlling a throttle valve to provide the intake airflow corresponding with the output restriction percentage value.

Figure 2:
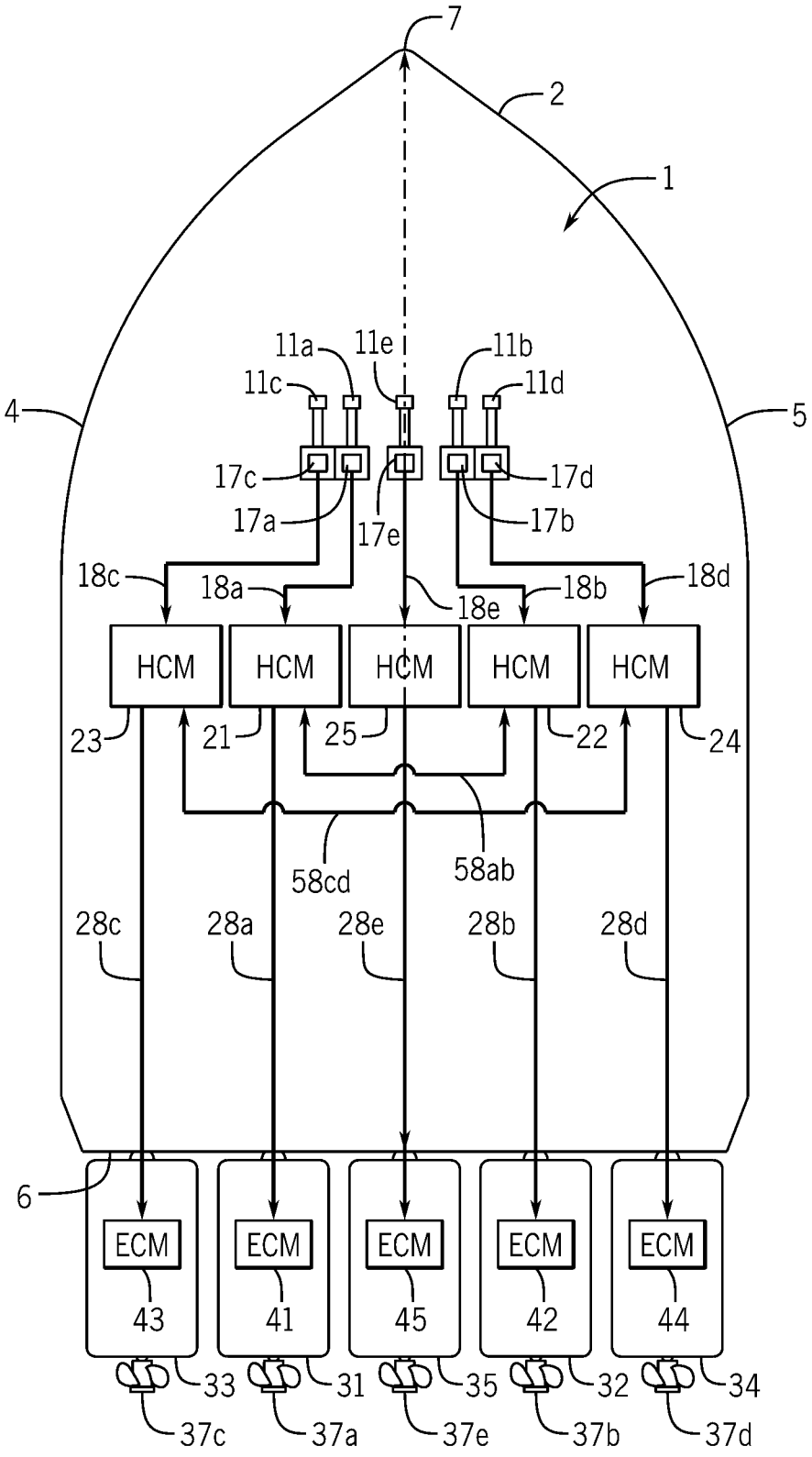
FIG. 2 schematically depicts another embodiment of a system for controlling propulsion of the marine vessel.

FIGS. 1 and 2 illustrate a marine vessel 2 having a system 1 for controlling propulsion in accordance with the present disclosure. The system 1 includes at least two marine drives (31 and 32 FIGS. 1 and 31-35 in FIG. 2), which in the depicted embodiments are outboard motors coupled to the transom 6 of the marine vessel 2. The marine drives 31-35 are attached to the marine vessel 2 in a conventional manner such that each is rotatable about a respective vertical steering axis in order to steer the marine vessel 2. In the examples shown and described, the marine drives 31 and 32 (and 31-35 in FIG. 2) are outboard motors; however, the concepts of the present disclosure are not limited for use with outboard motors and can be implemented with other types of marine drives, such as inboard motors, inboard/outboard motors, hybrid electric marine propulsion systems, pod drives, and the like.

In the examples shown and described, the marine drives have an engine that causes rotation of the drive shaft to thereby cause rotation of a propulsor shaft having a propulsor 37 at the end thereof, such as a propeller, impeller, or combination thereof. The propulsor 37 is connected to and rotates with the propulsor shaft propels the marine vessel 2.

The direction of rotation of the propulsor 37 is changeable by a gear system, which has a forward gear associated with a forward thrust caused by first rotational direction and a reverse gear associated with a backward thrust caused by the opposite rotational direction. As is conventional, the gear system is positionable between the forward gear, a neutral state (no thrust output), and the reverse gear. Such positioning may be controlled by a remote control 11 (FIGS. 1-3) associated with the respective marine drive 31-35. As is conventional, the remote control 11 includes a lever 50 movable by an operator into a reverse position at causes the gear system to shift into reverse gear, a neutral position that causes the gear system to shift into a neutral state, and a forward position that causes the gear system to shift into forward gear. The remote control lever 50 is also movable by an operator to provide control the throttle, and thus the thrust, within the respective gear.

Referring to FIG. 1, each marine drive 31, 32 is controlled by a respective command control module or helm control module (HCM) 21, 22, which is communicatively connected to an engine control module (ECM) 41, 42 for that respective marine drive 31, 32. The controller arrangements described herein are exemplary and a person of ordinary skill in the relevant art will recognize in light of this disclosure that different arrangements of control modules are possible and within the scope of this disclosure. The connection between the HCM 21, 22 and the ECM 41, 42 is via a communication link 28*a*, 28*b*, respectively, which in may be by any known means and in various embodiments could be a CAN bus for the marine vessel, a dedicated communication bus or link between the respective control modules 21 and 31, 22 and 32, or via a wireless communication protocol. Likewise, the first HCM 21 and the second HCM 22 are communicatively connected via communication link 58 so that information can be exchanged therebetween, which may also be by any known communication means including via a CAN bus, a dedicated communication bus between the respective HCMs 21 and 22, or via a wireless communication protocol. In other embodiments, the methods and systems described herein may be accomplished by the ECMs 41 and 42 associated with the respective marine drives 31 and 32 without the involvement of HCMs or other additional control modules, and in such an embodiment the ECMs 41 and 42 may be connected by any wired or wireless communication link as described above. For example, the ECMs 41 and 42 may directly communicate their output restriction status with one another, and may be equipped to execute methods to determine and implement a synchronizing output restriction.

In certain embodiments, each HCM 21, 22 is communicatively connected to a remote control 11*a*, 11*b* for controlling the operation of the respective marine drive 31, 32. In another embodiment, one or more of the marine drives 31-35 are controlled by a single remote control 11 communicatively connected to some or an HCMs 21-25 such that the throttle request is the same for the two or more drives and the throttles are not separately controllable by an operator. In one preferred embodiment, the remote control 11 is a drive-by-wire input device, and the position of the lever 50 sensed by the position sensor 17 will be translated into a control input to a throttle valve, for example. Such drive-by-wire systems are known in the art, an example of which is disclosed at U.S. Pat. No. 9,103,287 incorporated herein.

Figure 3:
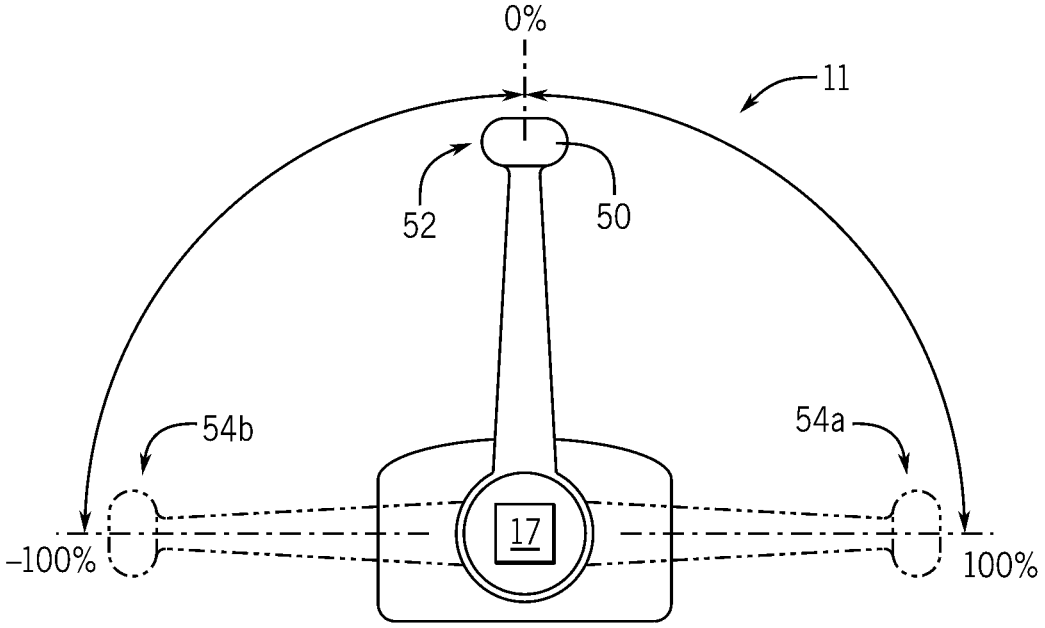
FIG. 3 depicts an exemplary remote control for a system for controlling propulsion of a marine vessel.

As shown in FIG. 3, each remote control 11 has a lever 50 positionable between a neutral position 52, which is a combined throttle and shift lever, associated with engine idle and a neutral position of the gear system, and a full forward throttle position 54*a* and a full reverse throttle position 54*b*. The full throttle positions 54*a*, 54*b* are associated with maximum power output in the respective gear, and the positions therebetween representing the various throttle positions between 0% and 100% associated with a corresponding airflow (and thus power output) between 0% and 100%. The position of the lever 50 is determined by the position sensor 17 providing an analog output or a digital output of angular position to a respective helm control module 21, 22. The position of the lever 50 may be expressed as a percent of the range of motion of the lever 50 in the respective direction—i.e., between 0% and 100% in the forward position and between 0% and −100% in the reverse direction. Each lever position between 0% and 100% is determined by the respective HCM 21, 22 to provide a throttle control command to control the throttle valve to provide a corresponding power output. For instance, a handle position of 50% corresponds with throttle control to provide 50% power output which is 50% of the maximum power output for the respective drive 31-35.

Alternatively or additionally, the throttle lever position may be correlated to an engine speed or other value that corresponds with outputs, such as airflow. Airflow may be sensed as described above. Engine speed is sensed by an engine speed sensor on each engine of each marine drive 31-35. For example, a tachometer may measure the actual rotational speed of the engine and communicate the measured engine speed to one or more controllers 41-45 and/or 21-25, such as via a time processing unit (TPU), as is conventional. The lever position may be measured by the position sensor 17 or sampled by the respective helm control module 21, 22 (depending on whether the position sensor 17 is an analog or digital device) at a fixed sampling rate, which in an exemplary embodiment may be in the range of 5 Hz to 10 Hz. For example, the position sensor 17 may be a programmable magnetic encoder, a clinometer, a Hall Effect sensor, a potentiometer, a rotary encoder, or the like. To provide just one example, the position sensor 17 may be part number 881070 by Mercury Marine of Fond du Lac, Wis.

In presently available multi-drive systems, HCMs exchange limited information between one another to carry out certain programming instructions that may require coordination between the marine drives 31 and 32. However, current systems for controlling propulsion on marine drives do not account for all sudden power imbalances caused mechanical failures, loss of fuel, or other problems with one, or a subset of, marine drives within the system, and thus the dangerous power imbalance described above can arise. Accordingly, in the presently disclosed solution developed by the inventors, the one or more controllers execute a method wherein one or more engine output indicators for each of the at least two marine drives 31-35 is monitored, which as described above may be one or more of a measured engine speed, a power output percent, a throttle valve position, an airflow value, or any other value correlating with engine output. The control system is further configured to detect whether the engine output indicator or subset of the at least two marine drives is below an expected value, wherein the expected value correlates in kind with the engine output indicator. For example, if a mechanical failure, loss of fuel, or other problem occurs with one or more of the marine drives 31-35, but not all of the marine drives, then a power imbalance will occur as described above and needs to be immediately remedied to avoid a dangerous situation. Thus, where the engine output indicator for a subset of the marine drives 31-35 is detected, the control system is configured to impose an output restriction on at least one of the remaining marine drives not in the subset of marine drives where the issue occurred.

The output restriction reduces the engine output of the at least one remaining marine drive to a predetermined level in order to balance power output on the marine vessel. In one example where the propulsion control system 1 includes more than two marine drives, the output restriction may be imposed on a marine drive that mirrors the position of the problematic drive so that the output is symmetrical with respect to the centerline 7. In another embodiment, the output restriction may be imposed on all remaining marine drives not in the subset of marine drives experiencing the problem. For example, the output restriction may be communicated to all ECMs 41-45, and wherein the remaining marine drives will effectuate a reduction in engine output in response thereto. The engine output of the problematic subset of marine drives experiencing the problem has already been reduced, and indeed is what initiated the output restriction on the remaining marine drives.

Figure 4:
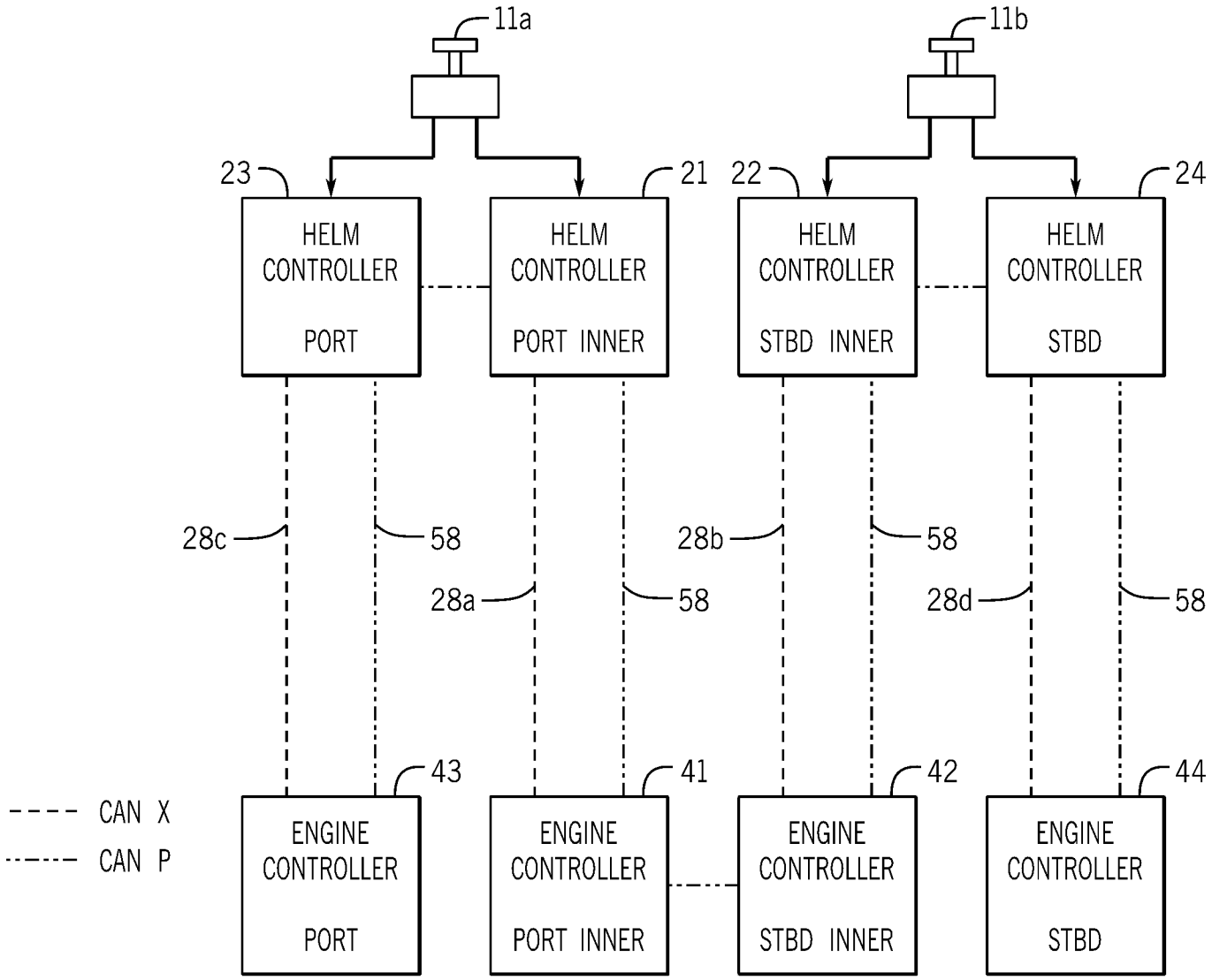
FIG. 4 schematically depicts one embodiment of a control arrangement comprising part of a system for controlling propulsion of a marine vessel according to an embodiment of the present disclosure.

The implementation of these control steps may vary depending on the control architecture for the system 1, and various control architectures are exemplified and described herein, though other examples will be known to persons of ordinary skill in the art in view of the relevant disclosure. FIG. 4 depicts another exemplary control architecture wherein four marine drives (31-34 not shown but similar to the examples of FIGS. 1 and 2) are provided in the system 1. The marine drives 31-34 are arranged with respect to the centerline 7 as described above and include a port inner, starboard inner, port outer, and starboard outer marine drives, 31-34 respectively. For this example, engine controller 41-44 is provided, one for each marine drive 31-34. Each marine drive 31-34 also has a corresponding helm controller 21-24. A remote control 11 is associated with each pair of marine drives on either side of the centerline 7, which includes remote control 11*a* associated with the marine drives 31 and 33 and the corresponding controllers, and remote control 11*b* associated with the starboard side marine drives 32 and 34 and associated controllers. Each remote control 11*a* and 11*b* includes at least one lever, such as the shift and throttle lever 50. The lever position of the corresponding lever 50 is thus communicated to at least the corresponding helm controllers, where the port side remote control 11*a* communicates to the helm controller 21 and 23 and the starboard side remote control 11*b* communicates to the helm controllers 22 and 24. Lever position information may be communicated between the remote controls 11*a*, 11*b* and the respective controllers via various means, such as via CAN bus architecture. In certain embodiments, the communication length between the remote control 11*a*, 11*b* and the controllers may be via a dedicated CAN bus, or by a shared CAN bus such as CAN "P" 58 as described herein. In certain embodiments, all helm controller 21-24 and/or all engine controllers 41-44 (depending on where the disclosed method steps for assessing output restriction are being executed) may be provided with the lever positions associated with all marine drives, such as via CAN "P" 58 as described herein.

In the depicted example, the communication link between the controllers 21-24 and 41-44 is via CAN architecture comprising two different types of CAN buses. A dedicated CAN bus 28*a*-28*d* is provided between each helm controller 21-24 and the respective engine controller 41-44 associated with each marine drive 31-34. The dedicated CAN buses 28*a*-28*d*, each labeled CAN "X" in FIG. 4, only communicates messages between one helm controller 21-24 and its corresponding engine controller 41-44. A second CAN bus 58 connects to all controllers 21-24 and 41-44. This universal communication bus 58, labeled CAN "P" in FIG. 4, provides communication link and message availability to all helm controllers 21-24 and engine controllers 41-44, as well as any other devices and systems communicating on that CAN bus 58.

Figure 5:
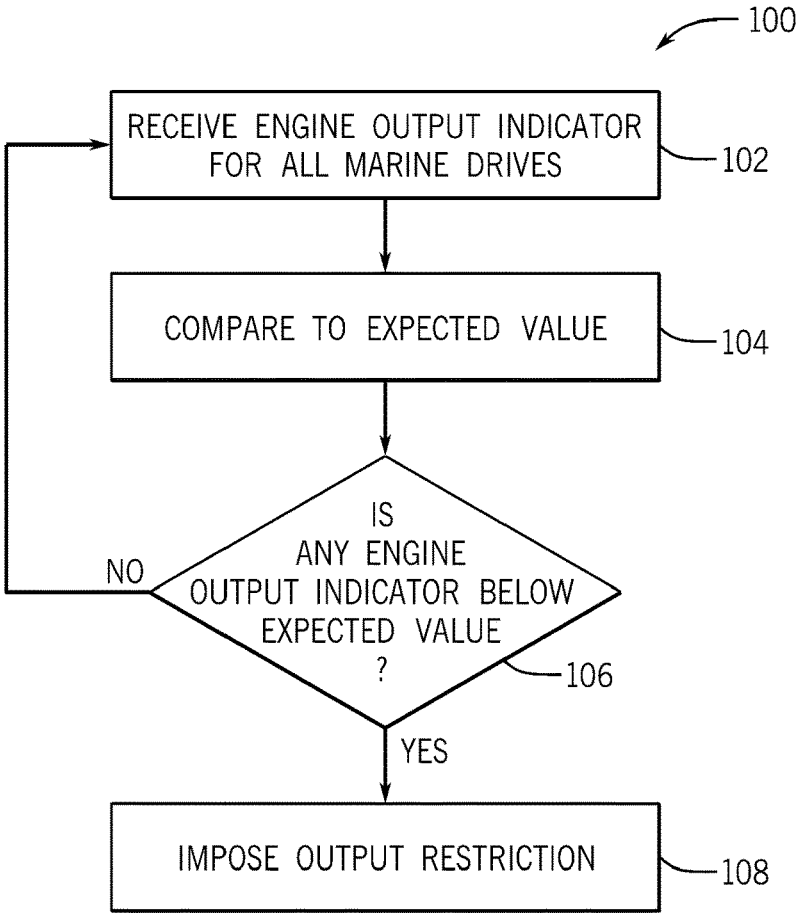
FIGS. 5-9 depict methods of controlling propulsion of a marine vessel according to embodiments of the present disclosure.

FIGS. 5-9 depict embodiments of methods for controlling propulsion of at least two marine drives, or portions of such methods, as will be explained further below. In FIG. 5, the method 100 for controlling propulsion of at least two marine drives on a marine vessel includes receiving an engine output indicator for all marine drives at step 102. For example, the engine output indicators may be communicated via the universal CAN bus 58 such that one or more of the helm controllers 21-24 receives engine output indicators for all marine drives 31-34. For example, each engine controller 41-44 may communicate such engine output indicator, which for example may be a current measured engine speed or current power output percent for the respective marine drive. Other values are also possible, as described above, and the system may be configured accordingly. Alternatively or additionally, the logic steps depicted at FIG. 5 may be executed by one or more of the engine controllers 41-44, and thus the engine output indicators for the remaining engine controllers would be communicated thereto. Execution in other control architectures is also feasible, as described above.

The engine output indicators are compared to an expected value at step 104, which may be a different expected value for each marine drive 31-34 or may be one expected value common to all marine drives. For example, the expected value may be based on a current level position of the throttle lever 50. Thus, where two or more of the marine drive 31-34 (or 31-35) are commonly controlled by one remote control 11 and throttle lever 50, the expected value for those marine drives may be the same. As another example, an expected engine speed may be an engine speed value corresponding to a set point of an electronic throttle controller executed within each respective engine controller 41-45. Thus, the system may determine whether the current measured engine speed for each marine drive is within a threshold range of the engine speed that is mapped to, and thus corresponds to the electronic throttle controller set point, which may be determined based on the lever position 50 for example.

Figure 8:
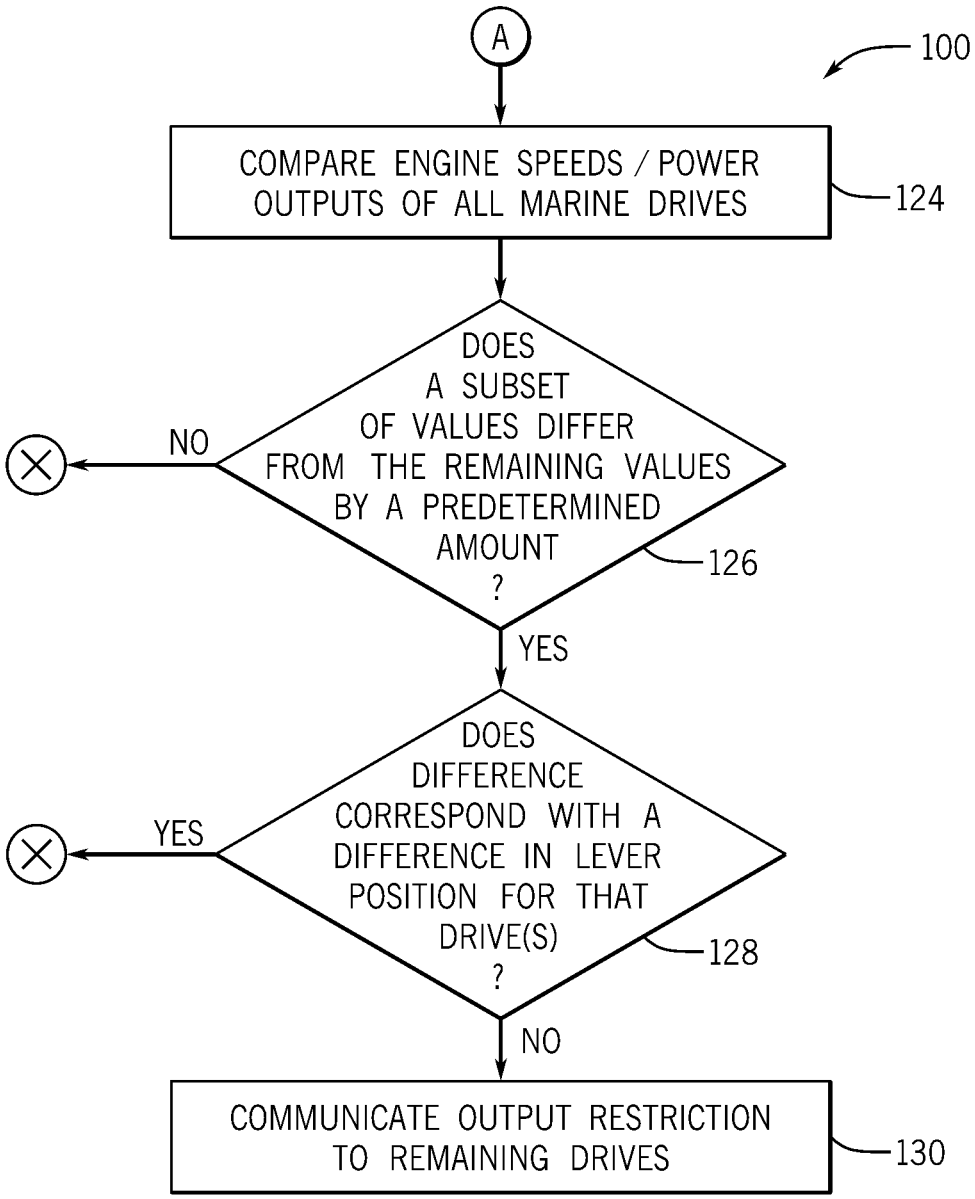

In other embodiments, the expected value may be based on the engine output values for all of the marine drives 31-35, such as a filtered average or other threshold value determined based on output indicators for one or more of the marine drives 31-35. FIG. 8 depicts one example of such method. At step 106, instructions are executed to determine whether any output indicator is below the expected value. If not, then the engine output indicators for the marine drives continue to be monitored and no action is taken. If one or more of the output indicators, but not all of the output indicators, are below the expected value, then an output restriction is imposed at step 108. For example, the output restriction may be a restricted engine speed or a restricted power output percent communicated to and/or effectuated by each engine controller 41-45. Thus, each engine of each of the remaining marine drives 31-35 where the problem did not occur, will be restricted accordingly in order to bring the output down to a predetermined level defined by the output restriction. Alternatively, only a portion of the remaining marine drives may be restricted, such as the one or more marine drives that mirror the location of the problematic marine drive that has the engine output indicator below the expected value. Thereby, the power output with respect to the centerline 7 of the marine vessel 5 can be balanced. In still other embodiments, differing output restrictions may be applied differently to the remaining marine drives. To provide one example, a more aggressive output restriction may be applied to the remaining marine drive that mirrors the problematic drive, and a less aggressive output restriction may be applied to the remaining marine drives.

For example, the engine speed and/or power output percent of the one or more remaining marine drives may be ramped down at a predetermined rate to the predetermined restricted engine speed or predetermined restricted power output, or other output restriction value. The restricted engine speed or power output is a calibrated safe output level determined by the hydrodynamic characteristics of the marine vessel, such as gear ratio, prop pitch, engine spacing, hull design, etc. To provide just one example, the restricted engine speed may be an engine speed between idle and 5000 RPM, such as 3000 RPM. Similarly, the restricted power output percent may be a power output percent value between 0% and 75% of a maximum output power of the marine drive, such as 40%. On a vessel that is relatively very stable, the restriction may be higher, such as on the top end of the provided ranges. On a less stable vessel, such as a racing vessel designed to optimize performance at top speeds, the restriction may be more aggressive and may be at the low end of the provided ranges, such as at or close to idle.

In certain embodiments, the disclosed method of controlling propulsion to avoid imbalance due to a sudden loss in output of one or more marine drives may only be conducted when the marine vessel is at high speed and/or high propulsion output. For example, prior to executing steps to analyze the output indicators with respect to the expected values, steps may be executed to determine whether the vessel conditions warrant this uniform output strategy, such as whether an unsafe condition would result from an imbalance in engine outputs. For example, the symmetric output analysis may be conducted once a vessel speed of the marine vessel exceeds a threshold vessel speed designating that the marine vessel is traveling at sufficiently high speed that a power imbalance could cause a safety issue. For example, the marine vessel 5 may be equipped with a sensor or device for measuring vessel speed, which may include one or more of a pitot tube, a paddle wheel, a GPS-based speed calculator, or the like, as is conventional.

Figure 6:
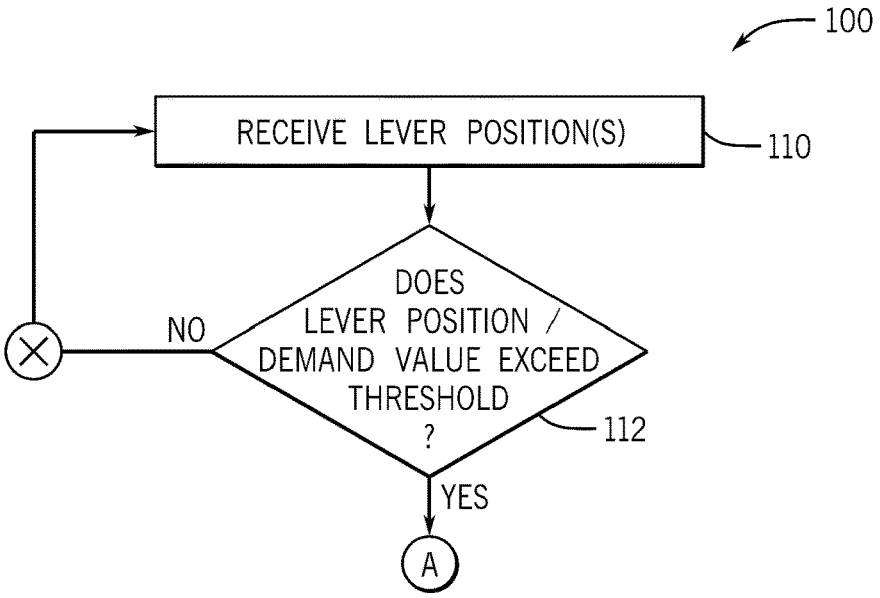

Alternatively or additionally, the power balancing method described herein may be executed once a throttle lever position of one or more throttle levers 50 on the marine vessel exceeds a threshold lever positon. Similarly, the power balancing method may be executed once a power output of one or more of the marine drives exceeds a threshold power output and/or an engine speed of one or more of the marine drives exceeds a threshold engine speed. FIG. 6 depicts one example. One or more lever positions are received at step 110. Instructions are then executed at step 112 to determine whether the lever position and/or a corresponding demand value exceeds a threshold. For example, analysis may be conducted to determine whether one of the levers exceeds the threshold, whether a subset of the levers exceeds the threshold, or whether all of the levers exceed the threshold. If not, then the lever positions continue to be monitored and the power balancing instructions described above are not executed, for example because the marine vessel is traveling at sufficiently low speed that a sudden loss of output by one of the marine drives will not cause a dangerous operating condition. If the conditions of step 112 are met, then steps are executed, such as those depicted at FIG. 5 or those depicted at any of FIGS. 7-9, to monitor for a power imbalance an impose an output restriction to restore power balance if such a power imbalance is detected.

Figure 7:
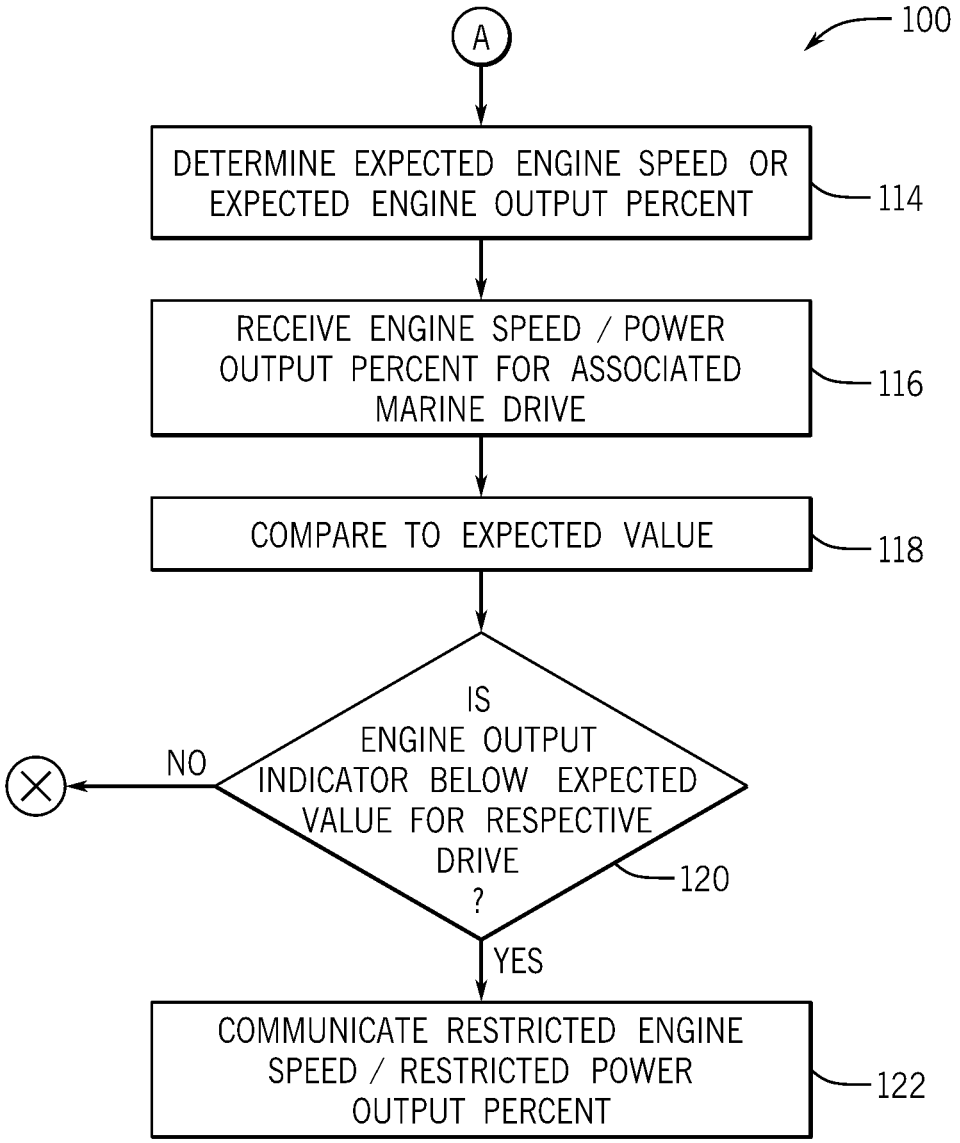

FIG. 7 depicts exemplary steps for monitoring and alleviating a power imbalance according to one embodiment. At step 114 an expected speed or expected engine output percent are determined based on the current lever position, such as the lever position received at step 110. For example, an expected value may be determined for each throttle lever 50. Thus, where each marine drive 31-35 has its own remote control 11 and/or throttle lever 50 then each marine drive may have a different expected value depending on the positions of the respective throttle levers 50. In other embodiments where one or more of the marine drives 31-34 shares control by a single throttle lever 50, the expected values for those marine drives 31-34 that share the throttle lever will be the same.

The current engine speed and/or current power output present for each respective marine drive is received at step 116. The current engine speed and/or current output percent are compared to the corresponding expected value at step 118. At step 120, instructions are executed to determine whether any of the engine output indicators—i.e., the current engine speed or current power output percent—is below the expected value for the respective marine drive 31-35. If not, then a round of analysis is completed and gets continually repeated so long as the lever positon (or vessel speed, or other vessel condition indicator) is above the threshold as described above. If one of the output indicators is below the expected value, then an output restriction is communicated at step 122 so that it can be imposed on all marine drives 31-35. In this case, the output restriction is a restricted engine speed for a restricted power output percent.

In one embodiment, the steps depicted at FIG. 7 may be executed at each helm controller 21-25, where each helm controller 21-25 receives the corresponding lever position and engine speed from its corresponding engine controller 41-45. Thus, each helm controller may monitor its own associated drive 31-35, and may communicate an output restriction, such as on the universal CAN bus 58, should a loss of power output for its associated marine drive 31-35 is detected. In other embodiments, such process steps may be executed at each engine controller 41-45. In still other embodiments, each helm controller 21-25 or engine controller 41-45 may analyze the output indicators and expected values for all other marine drives, and may impose an output restriction on its associated marine drive 31-35 upon detection of a power imbalance and/or may communicate detection of the power imbalance to other controllers in the system.

FIG. 8 depicts another embodiment for detecting and remedying the power imbalance in accordance with the present disclosure. In the embodiment at FIG. 8, the expected value is based on the engine output indicators for all of the marine drives. Specifically, the engine output indicators, such as the current engine speeds or current power output percents of all the marine drives are compared to one another at step 24. If a subset of those values—being one or more, but not all, of the indicator values—differs from the remaining values by a predetermined amount at step 126, then a power imbalance may be detected. In certain embodiments, additional steps may be conducted in order to verify that the difference does not correspond with the difference in lever positions between the marine drives. In the example, step 128 is conducted in order to determine whether the difference between the engine output indicators for the subset of marine drives and those of the remaining marine drives corresponds with a difference in the respective lever positions for those drives. If so, then the power imbalance is deemed intentional by the operator and an output restriction is not imposed on the remaining marine drives. However, if the difference does not correspond with a difference in lever positions, then the power imbalance is deemed in need of remedy and an output restriction is communicated to the remaining marine drives, or the engine controllers 41-45 thereof, at step 130.

Figure 9:
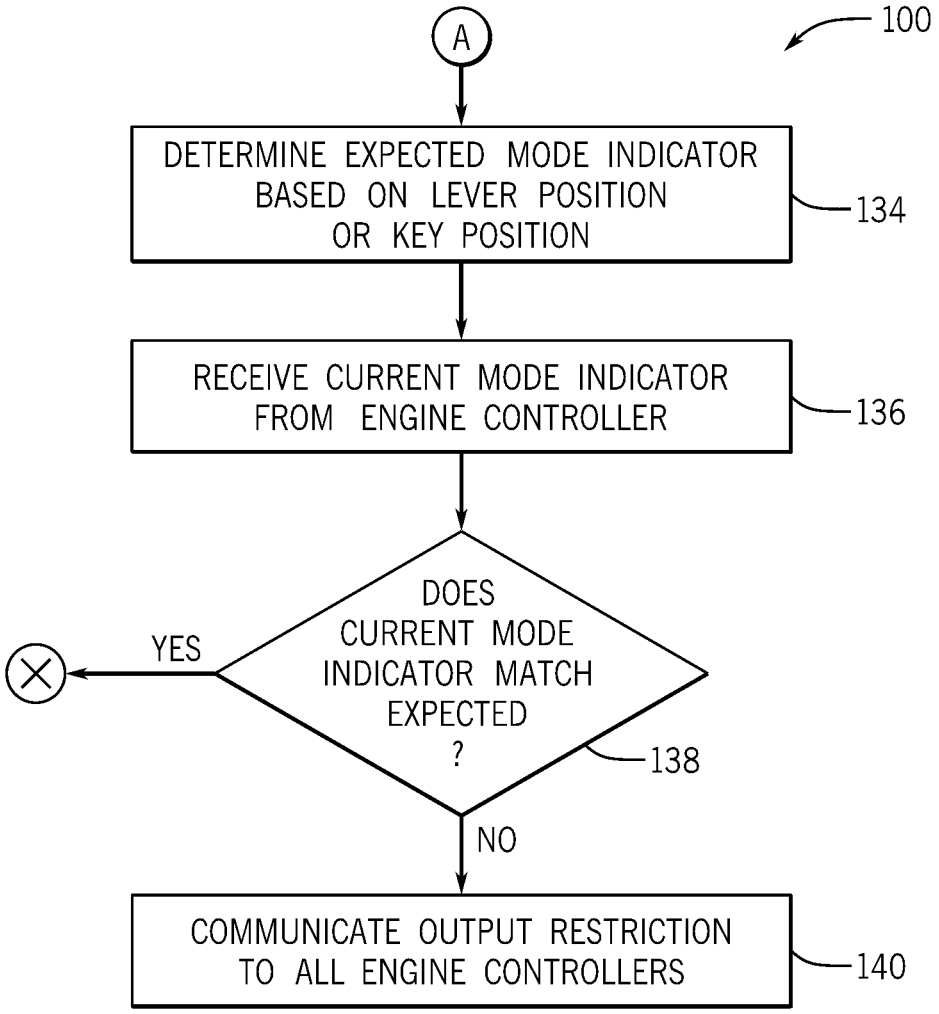

FIG. 9 depicts yet another embodiment of exemplary steps for identifying and remedying a power imbalance in accordance with the present disclosure. An expected mode indicator is determined at step 134 based on lever position. In certain examples, the expected mode indicator may be, for example, a run mode indicator, a stall indicator, or a crank mode indicator, among others. For example, the run mode indicator may be based on the lever position of the throttle/shift lever, and may be partially or primarily based on the lever position and/or key position for each marine drive. For example, where a marine drive is keyed on and a throttle/shift lever 50 is in a gear position, the expected mode indicator may be a run mode.

The various mode indicators for the marine drives 31-35 are then monitored to make sure they continue to match the expected mode indicator. Thus, the current mode indicators for each marine drive are received at step 136, such as from the respective engine controllers 41-45. For example, each helm controller 21-25 may receive the current mode indicator from its associated engine controller 41-45 and may assess whether it matches the expected mode indicator at step 138. If so, then no action is taken and the monitoring continues. If a mismatch is identified by one of the helm controllers 21-25, then an output restriction is communicated to the other controllers, so that the output restriction can be imposed on the remaining marine drives. For example, if the current mode indicator for one of the marine drives indicates a stall mode and the expected mode indicator is a run mode indicator, then a mismatch and loss of power output is identified for that marine drive.

The output restriction may be communicated, for example on the universal CAN bus 58, and received at the engine controllers 41-45 for the remaining marine drives such that it can be imposed thereby. In still other embodiments, parallel analysis of all engine mode indicators may be conducted simultaneously by one or more of the controllers 21-25 and/or 41-45 for each marine drive 31-35, as is described herein.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A method for controlling propulsion of at least two marine drives on a marine vessel, the method comprising:

monitoring an output indicator for each of the at least two marine drives on the marine vessel;

detecting whether the output indicator for a subset of the at least two marine drives is below an expected value indicating a malfunction of the subset of the at least two marine drives; and if the output indicator for the subset of the at least two marine drives is below the expected value, imposing an output restriction on at least one remaining marine drive not in the subset of the at least two marine drives, wherein the output restriction reduces an output of the at least one remaining marine drive to a predetermined level so as to reduce an output imbalance across a centerline of the marine vessel caused by the malfunction of the subset of the at least two marine drives.

2. The method of claim 1, wherein the output indicator is at least one of a measured rotational speed and a power output percent representing a percentage of a maximum output power of the marine drive.

3. The method of claim 2, wherein the expected value for each marine drive is at least one of an expected rotational speed and expected power output percent of a maximum power output for the respective marine drive.

4. The method of claim 1, wherein detecting whether the output indicator for the subset of the at least two marine drives is below the expected value includes comparing all of the output indicators to one another to determine whether the one or more of the output indicators differs from the others by at least a threshold amount.

5. The method of claim 4, wherein detecting whether the output indicator for the subset of the at least two marine drives is below the expected value further includes, after detecting that one or more of the output indicators differs from the others by the threshold amount, verifying that the differing output does not correspond with at least one of an expected rotational speed and an expected power output percent associated with a current lever position of a throttle lever controlling that marine drive.

6. The method of claim 1, wherein detecting whether the output indicator for the subset of the at least two marine drives is below the expected value includes, at an controller for each marine drive, determining whether a measured rotational speed of the respective marine drive differs by at least a threshold amount from an rotational speed corresponding to a setpoint of an electronic throttle controller.

7. The method of claim 1, wherein the output indicator is a stall mode indicator communicated by an controller for each of the subset of the at least two marine drives and the expected value is a run mode indicator.

8. The method of claim 1, wherein the predetermined level to which the output of the at least one remaining marine drive is reduced is at least one of a restricted rotational speed and a restricted power output percent.

9. The method of claim 8, wherein an rotational speed of the at least one remaining marine drive is ramped down at a predetermined rate to the restricted rotational speed.

10. The method of claim 8, wherein the restricted rotational speed is an rotational speed between idle and 5000 RPM.

11. The method of claim 1, further comprising determining that at least one of a vessel speed exceeds a threshold vessel speed, a throttle lever position exceeds a threshold lever position, a power output of at least one of the marine drives exceeds a threshold power output, and an rotational speed of at least one of the marine drives exceeds a threshold rotational speed prior to detecting whether the output indicator for the subset of the at least two marine drives is below the expected value.

12. The method of claim 1, further comprising removing the output restriction upon detecting that a throttle lever associated with the restricted marine drive is at or below a threshold lever position.

13. A system of controlling propulsion of a marine vessel, the system comprising:

at least two marine drives, including at least a first marine drive and a second marine drive;

at least a first controller associated with the first marine drive and at least a second controller associated with the second marine drive;

wherein the at least the first controller and the second controller are configured to:

monitor an output indicator for each of the at least two marine drives on the marine vessel;

detect whether the output indicator for a subset of the at least two marine drives is below an expected value indicating a malfunction of the subset of the at least two marine drives; and if the output indicator for the subset of the at least two marine drives is below the expected value, impose an output restriction on at least one remaining marine drive not in the subset of the at least two marine drives, wherein the output restriction reduces an output of the at least one remaining marine drive to a predetermined level so as to reduce an output imbalance across a centerline of the marine vessel caused by the malfunction of the subset of the at least two marine drives.

14. The system of claim 13, wherein the first controller is an controller for the first marine drive and the second controller is an controller for the second marine drive.

15. The system of claim 14, wherein detecting whether the output indicator for the subset of the at least two marine drives is below the expected value includes, at each of the first controller and the second controller, determining whether a measured rotational speed of the respective marine drive differs from an expected rotational speed by at least a threshold amount.

16. The system of claim 13, wherein each of the first controller and the second controller receive output indicators for each of the at least two marine drives.

17. The system of claim 16, wherein detecting whether the output indicator for the subset of the at least two marine drives is below the expected value includes comparing all of the output indicators to one another to determine whether the one or more of the output indicators differs from the others by at least a threshold amount.

18. The system of claim 16, wherein the output indicator is at least one of a measured engine rotational speed and a power output percent representing a percentage of a maximum output power of the marine drive, and the expected value for each marine drive is an expected rotational speed or expected power output percent associated with a current lever position of a throttle lever controlling that marine drive.

19. The system of claim 16, wherein the output indicator is a stall mode indicator communicated to at least a respective one of the first controller and the second controller by an controller for each of the subset of the at least two marine drives and the expected value is a run mode indicator.

20. The system of claim 13, wherein the predetermined level to which the output of the at least one remaining marine drive is reduced is a restricted rotational speed between idle and 5000 RPM or a restricted power output percent between 0% and 75%.

* * * * *